US006568018B1

(12) United States Patent
Chamberlin et al.

(10) Patent No.: US 6,568,018 B1
(45) Date of Patent: May 27, 2003

(54) WASHING MACHINE SPEED SENSOR

(75) Inventors: Edward R. Chamberlin, Loveland, OH (US); Alan Mark Faulhaber, Jr., Maineville, OH (US); Robert G. Whitman, Cincinnati, OH (US)

(73) Assignee: Standet International Corporation, Cincinnati, OH (US)

( * ) Notice: Subject to any disclaimer, the term of this patent is extended or adjusted under 35 U.S.C. 154(b) by 126 days.

(21) Appl. No.: 09/822,370

(22) Filed: Mar. 30, 2001

(51) Int. Cl.[7] ..... D06F 33/02

(52) U.S. Cl. ..... 8/159; 68/12.02; 68/12.12; 68/12.16

(58) Field of Search ..... 18/12.01, 12.02, 18/12.12, 12.16, 24, 58, 140; 34/427, 524, 88, 89, 90, 108; 8/159

(56) References Cited

U.S. PATENT DOCUMENTS

| | | | | |
|---|---|---|---|---|
| 3,216,226 | A | * | 11/1965 | Alger et al. |
| 3,403,538 | A | | 10/1968 | Andrew et al. |
| 4,542,633 | A | * | 9/1985 | Hirooka et al. |
| 4,843,671 | A | * | 7/1989 | Hirooka et al. |
| 5,561,990 | A | | 10/1996 | Berkcan et al. |
| 5,561,991 | A | | 10/1996 | Berkcan et al. |
| 5,576,620 | A | * | 11/1996 | Cheong |
| 5,669,095 | A | | 9/1997 | Dausch et al. |
| 5,671,494 | A | * | 9/1997 | Civanelli et al. |
| 5,823,017 | A | | 10/1998 | Hapke et al. |
| 6,151,742 | A | | 11/2000 | Dausch et al. |

FOREIGN PATENT DOCUMENTS

| | | | |
|---|---|---|---|
| CH | 429644 | * | 7/1967 |
| DE | 2915815 | * | 11/1980 |
| GB | 2079791 | * | 1/1982 |
| GB | 2124662 | * | 2/1984 |
| JP | 60-132598 | * | 7/1985 |
| JP | 62-155896 | * | 7/1987 |
| JP | 10-15277 | * | 2/1988 |
| JP | 64-40096 | * | 2/1989 |
| JP | 1-97497 | * | 4/1989 |
| JP | 03-007200 | | 1/1991 |
| JP | 4-44797 | * | 2/1992 |
| JP | 05-269292 | | 10/1993 |
| JP | 10-323483 | * | 12/1998 |
| JP | 11-37791 | * | 2/1999 |
| JP | 2000-210495 | * | 8/2000 |
| JP | 2001-276467 | | 10/2001 |

OTHER PUBLICATIONS

European Patent Office 631,001 Dec. 1994.*

* cited by examiner

*Primary Examiner*—Frankie L. Stinson
(74) *Attorney, Agent, or Firm*—Wood Herron & Evans LLP

(57) ABSTRACT

A washing machine (10) includes a one part sensor (60, 70) mounted to detect passage of a component normally associated with, and rotatable with, the drive shaft (25) of the machine (10) to detect speed of rotation of the shaft (25) and, in turn, speed of rotation of the clothes basket (22) without the need for a second, additional component not normally required for proper rotational operation of basket (22).

16 Claims, 6 Drawing Sheets

WASHING MACHINE SPEED SENSOR

BACKGROUND OF THE INVENTION

I. Field of the Invention

The present invention relates to washing machines and more particularly to speed sensors for sensing the speed of rotation of the clothes basket.

II. Description of Prior Art

Washing machines are commonplace in most homes. A typical washing machine includes a drive system having a motor operatively coupled to a drive shaft. The drive shaft includes a first or input shaft which rotates in response to the motor such as via a pulley, clutch and/or brake arrangement. The input shaft is coupled to a transmission having a second or output shaft of the drive shaft, and which in turn supports a clothes basket within a water tub, and an agitator for selective rotation with the clothes basket. In one mode of operation, such as during wash and rinse cycles, the output shaft is caused to rotate back and forth so as to rotate the basket and/or agitator back and forth to thus agitate the clothes and water in the basket for cleaning or rinsing of the clothing. In another mode, such as during the spin cycle, the output shaft spins quickly so as to spin the clothes basket and remove water from the clothing by centrifugal force.

For performance or safety reasons, it is often necessary to monitor the actual speed of rotation of the basket. For example, during the wash or rinse cycles, it may be important to know whether the basket is creeping or spinning. In some cases, whether in the wash or rinse cycle, or in the spin cycle, when the basket is rotating or spinning above a certain speed, it may be desirable to lock the lid closed to prevent someone from sticking their hands into the area of the basket. The speed may also be monitored to determine that the brake has failed, such as where the motor has been deenergized for some time, but the speed sensor continues to indicate that the basket is rotating too fast.

Where speed of rotation is to be detected, the practice has been to employ two part speed sensors. Two part speed sensors typically utilize a magnet and a reed switch (in addition to any magnet and reed switch which might be used to detect whether the lid is opened or closed), neither of which are part of the normal components which are mechanically coupled to and rotate with the drive shaft for proper mechanical rotational operation thereof. Instead, the separate magnet is provided primarily for the purpose of sensing speed and may be mounted for rotation with either the input or output shaft, such as by being taped or otherwise attached to the shaft or to the basket. The separate reed switch is fixedly mounted to a non-rotating part of the machine and adjacent the path of travel of the magnet to detect passage of the magnet during each revolution of the shaft and basket. Passage of the magnet causes changes in the state of the reed switch, resulting in signals from the reed switch over time indicative of the speed of rotation of the shaft and basket. Such two part speed sensors present certain drawbacks, both in terms of cost and reliability.

SUMMARY OF THE INVENTION

The present invention provides an improved speed sensor in a washing machine which eliminates the need for a two part sensor and instead relies on a one part speed sensor. To this end, and in accordance with one principle of the present invention, a one part speed sensor is fixedly mounted so as to detect passage of at least one of the components normally mechanically coupled to the drive shaft for rotation therewith to provide proper rotational operation of the shaft(s) and/or clothes basket. In this way, the speed of rotation may be detected by the sensor without the need to add to the shaft and/or basket a second part, such as a magnet, whose primary purpose is to detect speed such as by detection thereof by the sensor. As there is no need to add a second part for the purpose of sensing speed, as opposed to the purpose of providing proper mechanical rotational operation of the shaft, cost is thereby reduced. Additionally, as there is no such second part required, there is no risk of it coming loose, thereby improving reliability. Still further, a one part sensor can be positioned to detect passage of more than one of the components normally associated with the drive shaft for rotation therewith, thereby improving resolution, without the need for additional components. When the normally associated parts are ferrous metal, the one part sensor may be a variable reluctance sensor.

As will be appreciated, normally associated with the drive shaft by being mechanically coupled for rotation therewith are certain necessary metal components which are required to facilitate proper rotation of the shaft and basket from a mechanical perspective. By way of example, the drive shaft has mounted thereto a large metal counterweight and a transmission. The rotation of the counterweight may be detected by positioning a one part variable reluctance sensor adjacent the path of travel thereof to detect its passage on each rotation of the shaft and thereby sense the speed of rotation of the drum. Additionally, the metal screws that are typically part of the corresponding transmission housing may also be detected as they pass such as when the counterweight is out of phase with the sensor, to thereby enhance resolution.

In some washing machines, also mounted to the shaft is a metal brake plate which rotates therewith. The brake plate includes one or more apertures offset from the center thereof for mounting of springs or other components necessary for proper mechanical rotational operation of the drive shaft. A variable reluctance sensor may be positioned to detect passage of the aperture(s) as the shaft spins to thereby detect the speed of rotation of the basket. Where there are multiple such off-center apertures along the path of travel, resolution is enhanced. The shaft may be mounted in the machine by a fixed mounting plate situated in overlying relationship with the brake plate. The sensor may advantageously be mounted to the mounting plate so as to overlie the path of travel of the aperture(s). Where the mounting plate is solid, a sensor aperture may be formed therein over the path of travel with the sensor mounted at or into the sensor aperture.

By virtue of the foregoing, there is thus provided an improved speed sensor in a washing machine which eliminates the need for a two part sensor and instead relies on a one part speed sensor. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
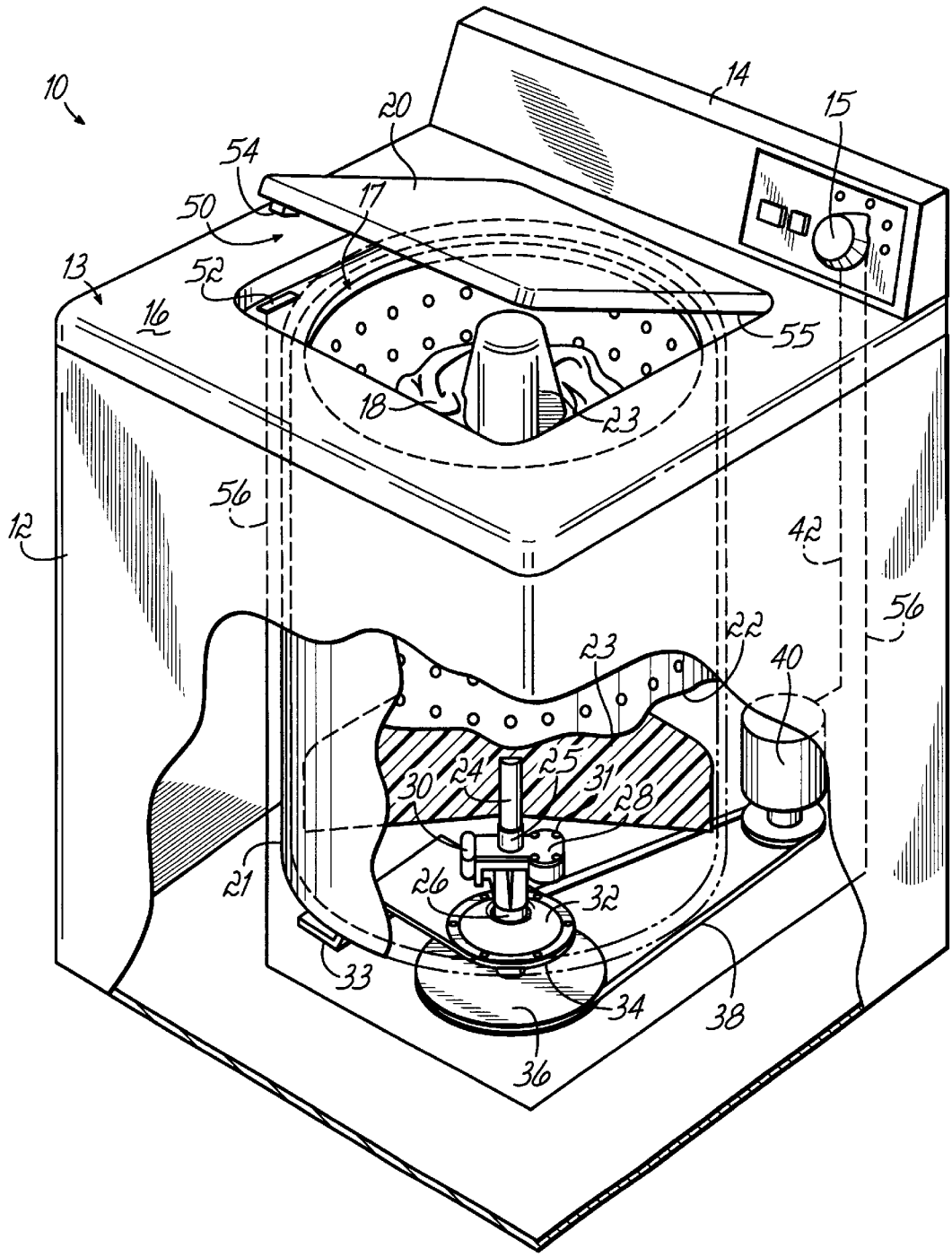
FIG. 1 is a perspective, partially cut-away view of a washing machine for purposes of explaining the principles of the present invention.

With reference to FIG. 1 there is shown an exemplary, conventional washing machine 10 for purposes of explaining the principles of the present invention. Washing machine 10 includes a shell or housing 12, which may be comprised of several adjoined pieces. At one end of top 13 of machine 10 is a control panel 14 housing therein the controls 15 of machine 10. Controls 15 may be electronic, programmable, electromechanical or a combination thereof as is conventional. Also across the top 13 of machine 10 is a user-accessible surface 16 with an opening 17 through which clothes 18 are to be loaded into or removed from machine 10. A lid 20 is hingedly mounted at top 13 and which, as is conventional, may be open (as shown) for loading and removal of clothing 18, or closed (not shown).

Washing machine 10 also includes a water tub 21 containing a rotatably mounted clothes basket 22 which holds the clothing 18. Basket 22 includes a central agitator 23, and is mounted for rotation on the output shaft 24 of a drive shaft 25 that extends within housing 12 and below basket 22. Drive shaft 25 includes an input shaft 26. Mounted for rotation with drive shaft 25 and coupling input shaft 26 and output shaft 24 is a transmission 28 having at one end thereof a large metal counterweight 30 which rotates with drive shaft 25. Transmission 28 may include metal screws 31 as part of the transmission. Transmission 28 facilitates back and forth rotation for agitation during wash and rinse cycles, and for spinning speeds during the spin cycle all as indicated by controls 15, while counterweight 30 balances the system during rotation so as to provide proper mechanical rotational operation of shaft 25 and basket 22. Counterweight 30, transmission 28, and transmission screws 31 are thus normal components necessary for proper mechanical rotational operation of shaft 25 and/or basket 22.

Shaft 25, and particularly input shaft 26 thereof, is held to housing 12 by a fixed mounting plate 32 secured to a support 33 in housing 12. Shaft 26 extends rotatably through mounting plate 32 to metal, rotatable brake plate 34. Brake plate 34 is coupled to pulley 36 to rotate input shaft 26. Pulley 36 is coupled, such as by a drive belt 38, to motor 40 which is selectively energized over cable 42 by controls 15.

Washing machine 10 may also include a lid switch system 50 including a reed switch 52 mounted at top 13 along surface 16 and magnet 54 affixed along the underside 55 of lid 20 so as to overlie reed switch 52 when lid 20 is closed. Reed switch 52 is coupled to controls 15 and/or motor 40 via cable 56 to provide an indication that lid 20 is open or closed.

Figure 2:
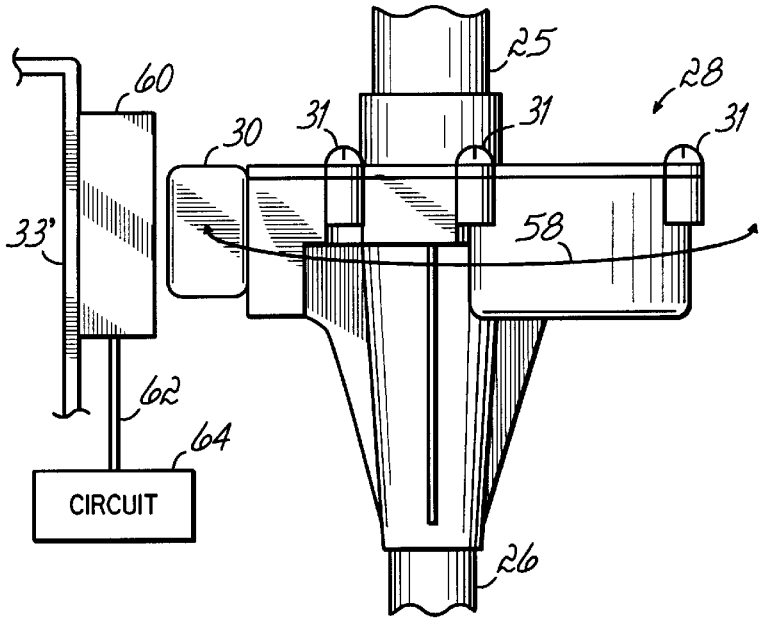
FIG. 2 is an elevational, highly schematic view of a portion of the drive shaft with the counterweight and transmission of the washing machine of FIG. 1 modified to show a one part speed sensor according to a first embodiment of the present invention.
Figure 7:
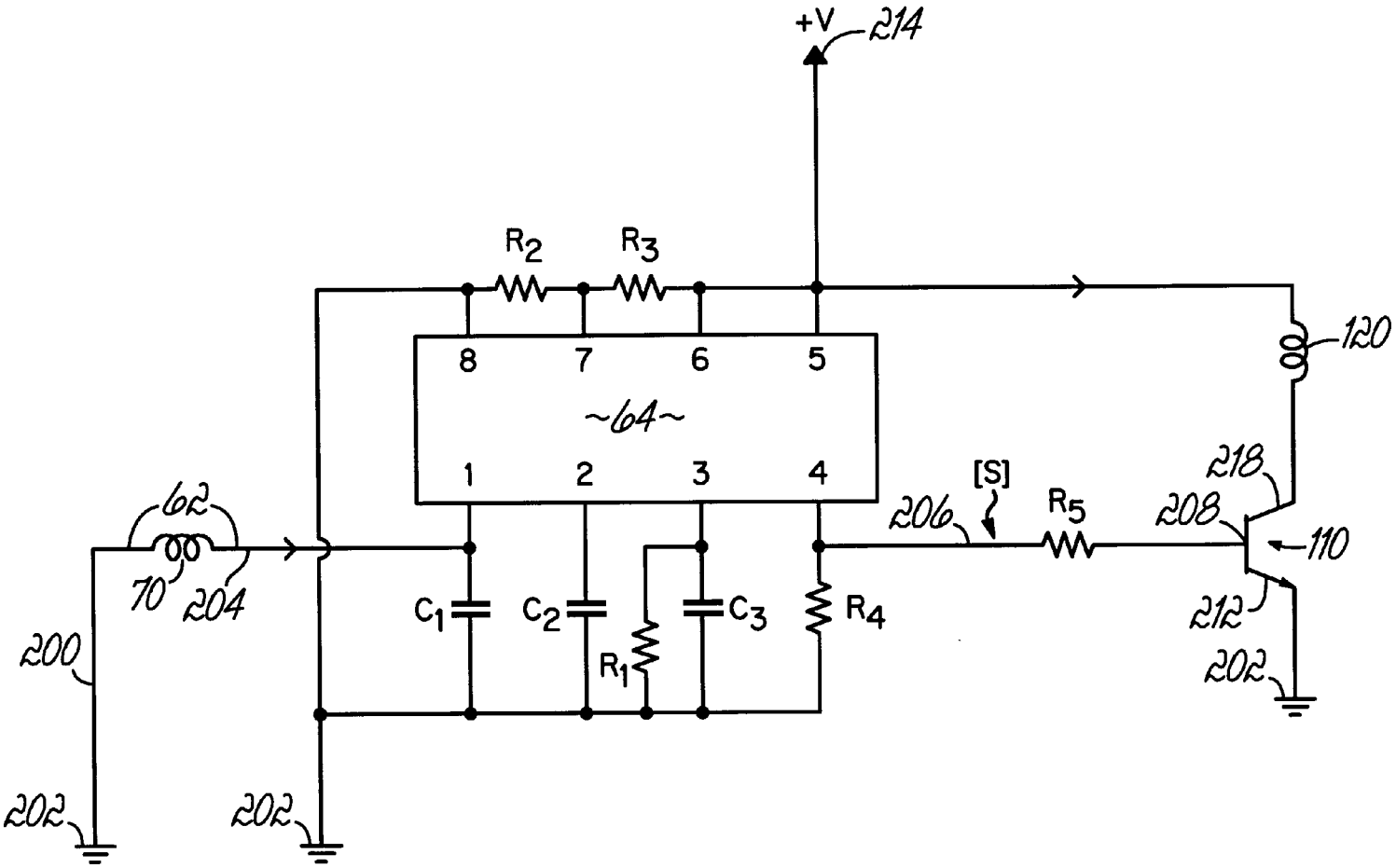
FIG. 7 is a schematic of an exemplary circuit for employing a one part speed sensor to provide a spin signal, such as might be used to actuate a lid lock mechanism.

As shown schematically in FIG. 2, counterweight 30 is of a significant size and mass, and is typically of ferrous metal. Counterweight 30 rotates with shaft 25 to define a path of travel (indicated by arrow 58). The speed of rotation of shaft 25 may be sensed by sensing passage of counterweight 30 along its path of travel 58. To this end, and in accordance with the principles of the present invention, a one part speed sensor 60, such as a variable reluctance sensor, may be fixedly mounted within housing 12 (such as on support 33' coupled to support 33) so as to detect passage of counterweight 30 along its path of travel 58. As counterweight 30 passes by sensor 60, signals are generated by sensor 60 which may be coupled over cable 62 to a circuit 64 (an example of which is shown schematically in FIG. 7) either separate from or forming part of controls 15. Circuit 64 utilizes the sensor signals 62 to determine the speed of rotation (RPM) of shaft 25 by sensing the signals 62 over time by which to output therefrom a speed signal that is either correlated to the RPM of the basket 22 or indicates whether the speed is above or below a predetermined RPM depending upon the intended use of the speed signal.

As further shown in FIG. 2, transmission 28 supports counterweight 30 and may also include ferrous metal screws 31 thereon. Screws 31 may lie in the same path of travel 58 as counterweight 30 and may thus also be sensed by sensor 60 to thereby increase resolution thereof. As will thus be appreciated, the speed of rotation of basket 22 may be sensed without addition of a second part, such as a magnet, the purpose of which is otherwise generally unrelated to proper rotation of the shaft 25 or basket 22.

Figure 3A:
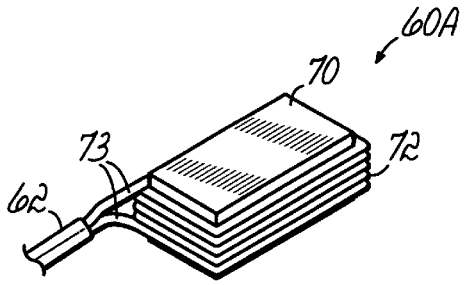
FIGS. 3A and 3B are perspective views of exemplary embodiments of the sensor of FIG. 2.
Figure 3B:
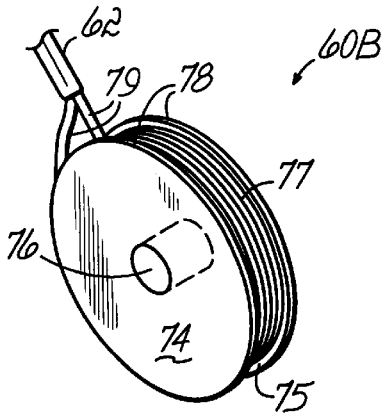

With reference to FIGS. 3A and 3B, two exemplary variable reluctance sensors 60A and 60B are shown. Sensor 60A is defined by a steel core 70 with copper wire 72 coiled thereabout, the ends 73 of which are coupled to cable 62. Sensor 60B is defined by a pair of 0.03 inch thick fiberglass flanges 74, 75 mounted to opposite sides of a button magnet 76. Magnet wire 77 is coiled about button magnet 76 to a level not outside the periphery 78 of flanges 74, 75. The ends 79 of magnet wire 77 are coupled to cable 62. Sensors 60A or 60B are mounted so that passage of counterweight 30 across the sensor will generate induced voltage in the wire 72 or 77, respectively.

Figure 4:
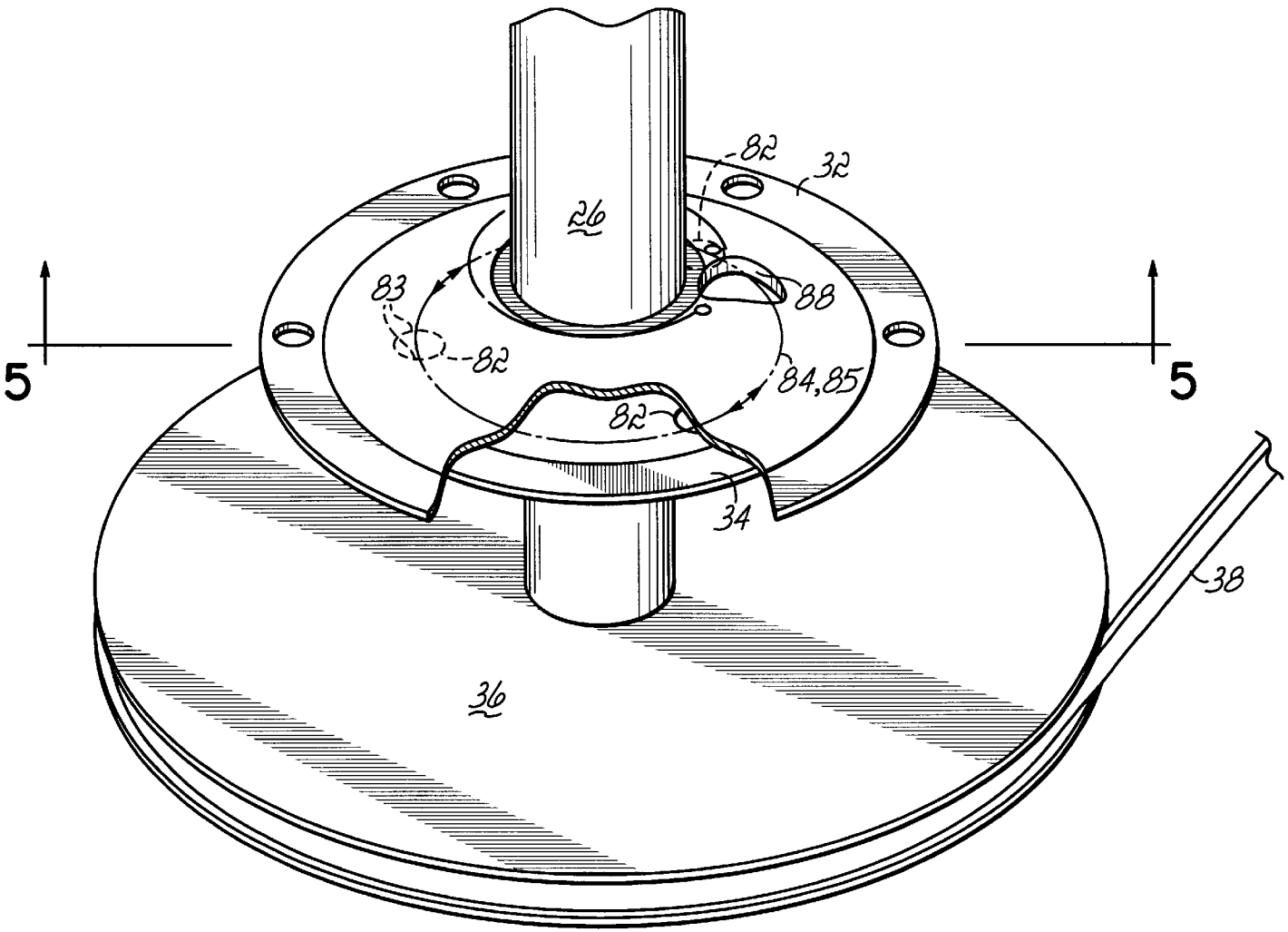
FIG. 4 is a perspective, partially cut-away view of the drive shaft, brake plate, and mounting plate of the washing machine of FIG. 1 modified with a sensor aperture for mounting of a one part speed sensor according to a second embodiment of the present invention.
Figure 5:
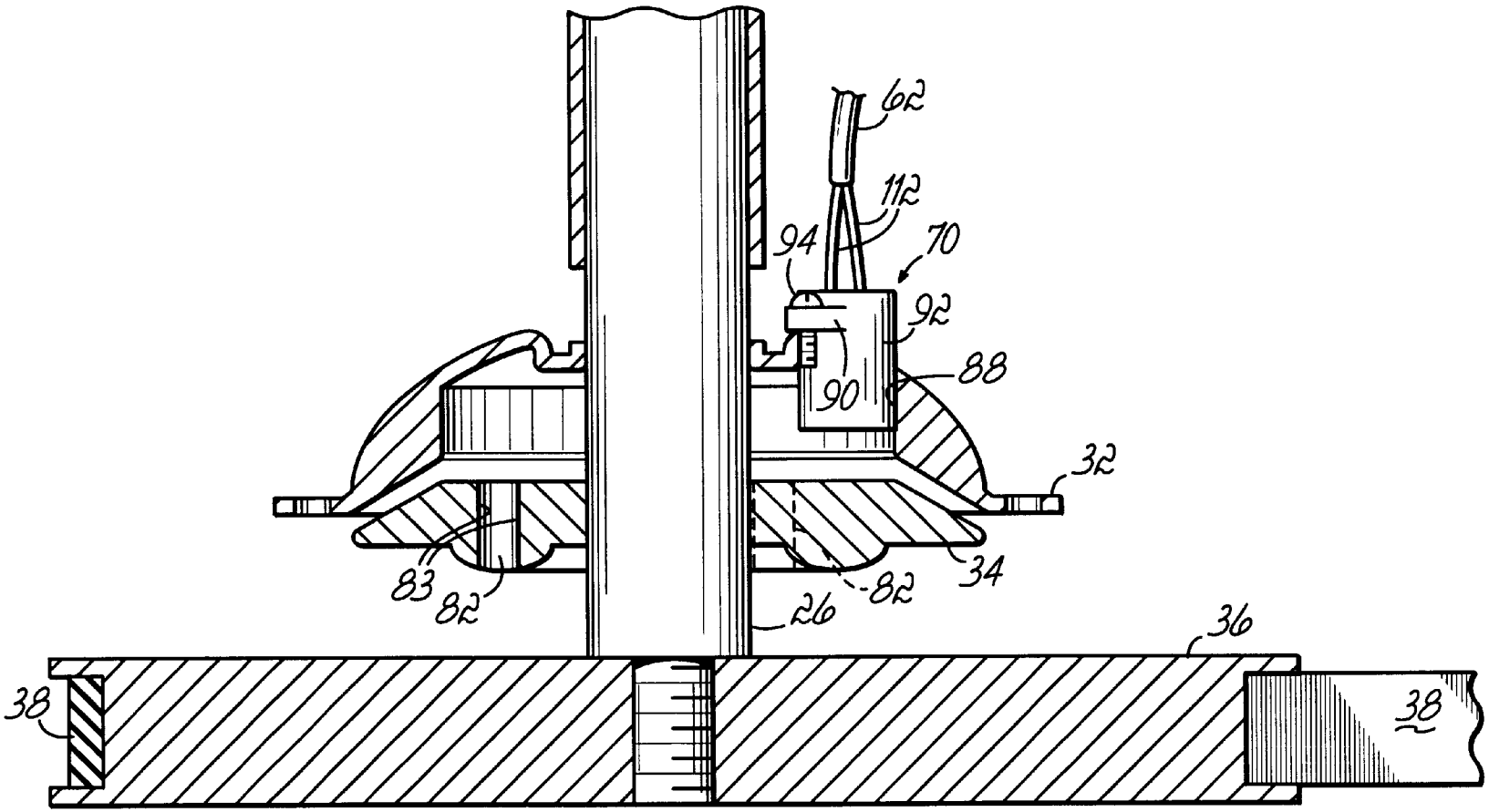
FIG. 5 is a cross-sectional view taken along line 5—5 of FIG. 4 with a one part sensor added.
Figure 6:
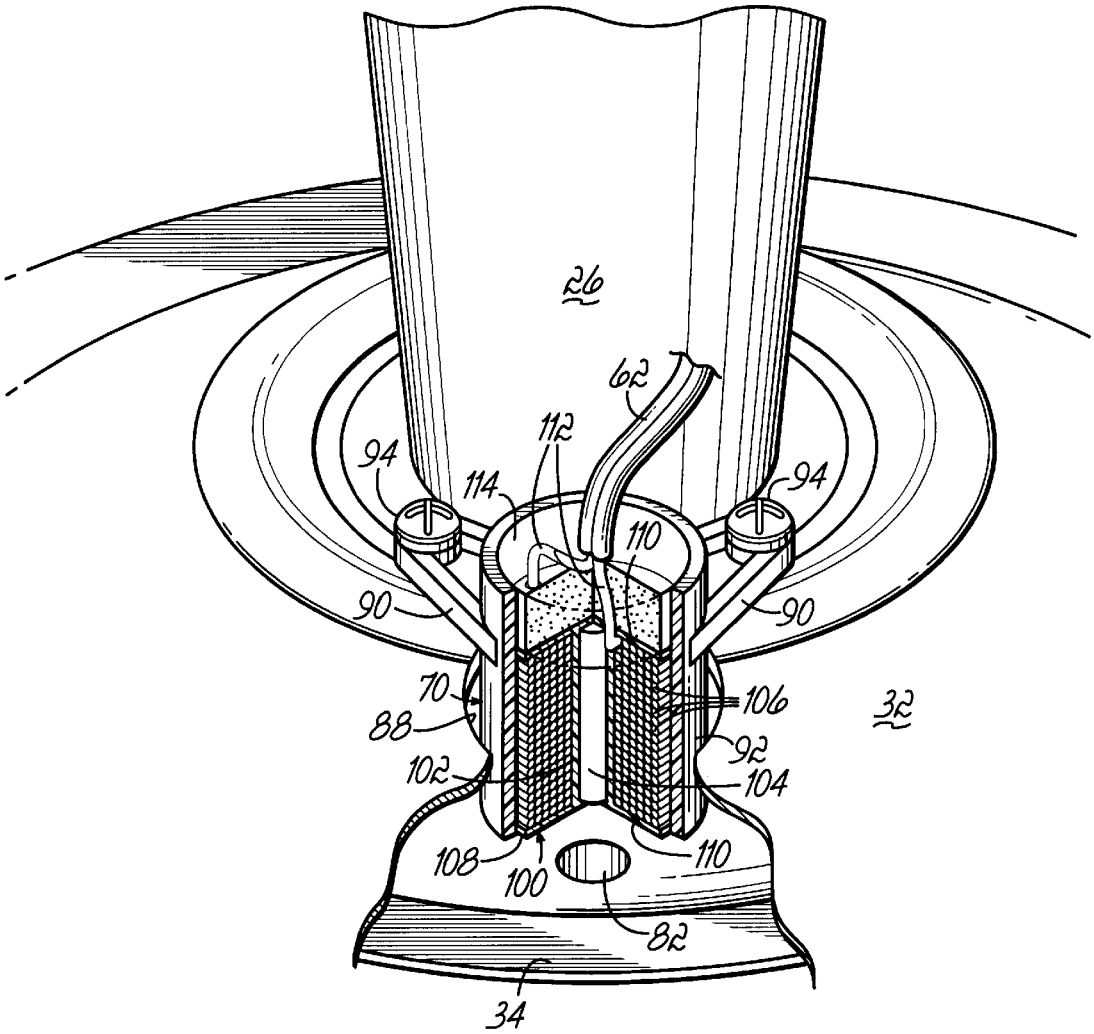
FIG. 6 is a perspective, partially cut-away view of FIG. 5.

An alternative or additional one part sensor 70 may be mounted to detect passage of a different component normally mechanically coupled for rotation with drive shaft 25 for proper mechanical rotational operation thereof. To this end, and with reference to FIGS. 4, 5 and 6, ferrous metal brake plate 34 normally includes one or more off-center apertures 82 by which to affix springs or the like (not shown) thereto for proper mechanical rotational operation of drive shaft 25. Thus, the apertures 82 are not additional or otherwise added to machine 10 for purposes of speed detection. Rather, and in accordance with the principles of the present invention, the pre-existing requirement for those apertures 82 in machine 10 may be advantageously utilized to detect the speed of rotation of drive shaft 25 and hence basket 22. To this end, a one part speed sensor 70 is fixedly mounted within machine 10 to detect passage of one or more of apertures 82 (either the aperture itself and/or edges 83 thereof) along the path of travel thereof as indicated by arrow 84. In the exemplary embodiment shown, three such apertures 82 are provided evenly spaced around brake plate 34 along a circumference 85 a fixed radius from input shaft 26 and which coincides with path of travel 84. As shaft 26 and brake plate 34 rotate, the aperture(s) 82 pass along path of travel 84 for detection by sensor 70. Where more than one of the apertures 82 share path 84, then sensor 70 may detect the passage of all such apertures 82 (and/or related edges 83) thus Improving resolution of the speed detection.

Typically, brake plate 34 will be positioned below mounting plate 32 which is secured thereover. Sensor 70 is advantageously fixedly mounted to plate 32 which is usually solid to cover up plate 34 and apertures 82 thereof. To facilitate use of sensor 70, plate 32 may be provided with a sensor aperture 88 situated to overlie path 84. Sensor 70 is mounted at aperture 88 such as by support legs 90 of plastic housing 92 being held to plate 32 with screws 94 extending through legs 90 and into plate 32. Sensor 70 may project into aperture 88 and towards brake plate 34. Sensor 70 provides a speed signal over cable 62, as did sensor 60, which may be utilized, such as in circuit 64, to determine the RPM of shaft 26 and thus the speed of rotation of basket 22.

Sensor 70 may be any self-contained unit that can detect passage of apertures 82 and/or edges 83 and may be optical or electrical. Advantageously, sensor 70 is a variable reluctance sensor, an exemplary embodiment of which will be described with reference to FIG. 6. Variable reluctance sensor 70 includes a plastic bobbin 100 having a central axle 102 surrounding a central magnet 104 extending therethrough. Magnet wire 106 is wound about the bobbin axle 102 within the periphery 108 of bobbin flanges 110, and bobbin 110 is encased within housing 92 by potting material 114. The ends 112 of wire 106 are coupled to cable 62 to provide the sensor signal(s) created by detection of the passage of apertures 82 and/or edges 83. The diameter of bobbin 100 is related to the diameter of aperture(s) 82 such that the smaller the diameter of bobbin 100 relative to the aperture 82 diameter, the greater the sensitivity is thought to be. One exemplary sensor 70 may thus be formed of a bobbin 100 having a diameter of 0.600 inches, and a length of 0.500 inches with 2500 turns of #41 magnet wire 106. The central magnet 104 may have ceramic C5 characteristics.

While the speed of rotation of shaft 25 and/or basket 22 may be used for any number of purposes, one possible use is to lock the lid 20 in the closed position over basket 22. Any desired lid lock mechanism may be employed but may include an electromechanical actuator 120 which is responsive to a spin signal S as will be described with reference to FIG. 7. To this end, and by way of example, sensor 70 may be coupled via cable 62 to provide the sensor signals 62 to circuit 64. Circuit 64 as shown herein is designed to output as a speed signal a binary logic spin signal S whenever the sensor signals 62 indicate that the speed of rotation is at or above a preselected RPM, such as 20 RPM or 100 RPM, and a no-spin signal (or $\overline{S}$) when the speed of rotation is below the predetermined speed. To this end, circuit 64 may be a frequency to voltage converter, such as an LM2907N-8 or equivalent set up as a speed switch. To use circuit 64, one wire 200 of cable 62 is coupled to a ground rail 202 and the other wire 204 thereof is coupled to pin 1 of circuit 64 and through 0.1 $\mu$F capacitor C1 to ground 202. Pin 2 of circuit 64 is coupled to ground 202 through 1 $\mu$F capacitor C2, with pin 3 coupled to ground 202 through the parallel combination of 1 $\mu$F capacitor C3 and 1 MΩ resistor R1. Pin 4 provides the output 206 for the spin signal (S) and is coupled to ground 202 through 1 KΩ resistor R4 and is also coupled to the base 208 of NPN transistor 210 through 1 KΩ resistor R5. The emitter 212 of transistor 210 is directly coupled to ground 202. Pins 5 and 6 are directly coupled to the power supply rail 214, and the collector 218 of transistor 210 is coupled through actuator 120 to supply rail 214. Pin 8 is directly coupled to ground 202 with pin 7 coupled to ground 202 through 100 KΩ resistor R2 and through 100 KΩ resistor R3 to supply rail 214. When the basket 22 is rotating above a predetermined speed, the output 206 will turn on (S) causing transistor 210 to conduct and thereby energize actuator 120 and lock the lid 20. When the speed of basket 22 falls below the predetermined speed, the output 206 will change the state of, or turn off, spin signal S thereby deenergizing actuator 120 and allowing lid 20 to be opened.

In use, a one part sensor, such as sensor 60 or 70, is fixedly mounted in washing machine 10 so as to detect passage of a component normally associated and rotatable with drive shaft 25 (that term being used to mean that the component is normally mechanically coupled for rotation with drive shaft 25 to provide proper mechanical rotational operation thereof and/or basket 22, and not to refer to a component added primarily for the purpose of detecting speed of rotation of shaft 25 or basket 22). Sensor 60 or 70 thus generates signals responsive to detection of passage over time of a component normally associated with the drive shaft for proper rotational operation thereof, to thereby indicate the speed of rotation of shaft 25 which correlates to the speed of rotation of basket 22. The sensor signal from sensor 60 or 70 may be utilized as necessary by controls 15, one example of which is to cause the lid 20 to be locked closed whenever the speed of rotation detected by the sensor exceeds some preset minimum. Other uses will be readily apparent such as to determine creep or spin of the basket 22 in the wash or rinse cycles, to indicate spin speed(s) in the spin cycle, and/or to indicate brake failure or the like.

By virtue of the foregoing, there is thus provided an improved speed sensor in a washing machine which eliminates the need for a two part sensor and instead relies on a one part speed sensor.

While the present invention has been illustrated by the description of embodiments thereof, and while the embodiments have been described in considerable detail, it is not intended to restrict or in any way limit the scope of the appended claims to such detail. Additional advantages and modifications will readily appear to those skilled in the art. For example, counterweight 30, screws 31 and/or brake plate 34 are typically of a conductive and magnetizable or ferrous metal such as steel, but may be of any metal to which sensor 60 or sensor 70 will react by creating a signal, such as but not necessarily an induced signal, as the component passes by the sensor. Alternatively, one part sensors could detect passage of other components normally associated and rotatable with the shaft, such as a flat (not shown) formed on the output shaft 24, by way of example. Thus, while sensors 60 and 70 are advantageously shown as variable reluctance sensors in that they respond to passage of a magnetizable metal component by inducing a signal in a magnet wire winding forming the sensor, those skilled in the art will recognize other one part sensor structures by which to detect passage of the normally associated, rotating component and generate a signal responsive thereto. Moreover, while one exemplary use of the one part sensor for the lid locking function is described, the present invention is not limited thereto, and is applicable to any use where the speed of rotation of the basket or drive shaft is of concern or to be measured. The invention in its broader aspects is, therefore, not limited to the specific details, representative apparatus and method, and illustrative examples shown and described. Accordingly, departures may be made from such details without departing from the spirit or scope of the general inventive concept.

Having described the invention, what is claimed is:

1. In a washing machine having a drive shaft coupled to spin a basket and a motor operatively coupled to the drive shaft, a one part speed sensor for sensing the speed of rotation of the basket, the speed sensor comprising:

a one part sensor fixedly mounted relative to the drive shaft to detect passage of a component normally associated and rotatable with the drive shaft, the detection of passage thereof over a period of time correlating to the speed of rotation of the basket, whereby a second part not normally associated and rotatable with the drive shaft need not be added to the washing machine to detect speed;

wherein the washing machine includes a counterweight normally associated and rotatable with the drive shaft, the sensor being fixedly mounted to detect passage of the counterweight whereby to sense the speed of rotation of the basket.

2. In a washing machine having a drive shaft coupled to spin a basket and a motor operatively coupled to the drive shaft, a one part speed sensor for sensing the speed of rotation of the basket, the speed sensor comprising:

a one part sensor fixedly mounted relative to the drive shaft to detect passage of a component normally associated and rotatable with the drive shaft, the detection of passage thereof over a period of time correlating to the speed of rotation of the basket, whereby a second part not normally associated and rotatable with the drive shaft need not be added to the washing machine to detect speed;

wherein the washing machine includes a counterweight and a transmission normally associated and rotatable with the drive shaft, the sensor fixedly mounted to detect respective passage of the counterweight and an aspect of the transmission whereby to sense the speed of rotation of the basket.

3. In a washing machine having a drive shaft coupled to spin a basket and a motor operatively coupled to the drive shaft, a one part speed sensor for sensing the speed of rotation of the basket, the speed sensor comprising:

a one part sensor fixedly mounted relative to the drive shaft to detect passage of a component normally associated and rotatable with the drive shaft, the detection of passage thereof over a period of time correlating to the speed of rotation of the basket, whereby a second part not normally associated and rotatable with the drive shaft need not be added to the washing machine to detect speed;

wherein the washing machine includes a brake plate normally associated and rotatable with the drive shaft, the brake plate having at least one aperture offset from a center thereof, the sensor being fixedly mounted to detect passage of the aperture whereby to sense the speed of rotation of the basket; and wherein a mounting plate is secured over the brake plate for mounting the shaft to the washing machine, the sensor being fixedly mounted to the mounting plate.

4. In the washing machine of claim 3, the mounting plate including a sensor aperture formed therein situated to overlie a path along which the mounting plate aperture travels, the sensor being fixedly mounted to the mounting plate at the sensor aperture.

5. In the washing machine of claim 4, the sensor being mounted to project into the sensor aperture.

6. In a washing machine having a drive shaft coupled to spin a basket and a motor operatively coupled to the drive shaft, a one part speed sensor for sensing the speed of rotation of the basket, the speed sensor comprising:

a one part sensor fixedly mounted relative to the drive shaft to detect passage of a component normally associated and rotatable with the drive shaft, the detection of passage thereof over a period of time correlating to the speed of rotation of the basket, whereby a second part not normally associated and rotatable with the drive shaft need not be added to the washing machine to detect speed;

wherein the component normally associated and rotatable with the drive shaft includes ferrous metal, the sensor being a variable reluctance sensor adapted to generate signals responsive to passage of metal.

7. A method of sensing speed of rotation of a basket in a washing machine with a one part speed sensor comprising:

providing a washing machine with a drive shaft operatively coupled to rotate the basket, the drive shaft having normally associated and rotatable therewith a plurality of components necessary for proper mechanical rotational operation of the basket; and mounting a one part sensor to detect passage of at least one of said normally associated components whereby to provide a signal correlated to the speed of rotation of the basket without requiring addition of a second part for rotation with the drive shaft and whose purpose is primarily to function as part of a speed sensor;

wherein one of said normally associated components is a counterweight, the method further comprising mounting the sensor to detect passage of the counterweight.

8. A method of sensing speed of rotation of a basket in a washing machine with a one part speed sensor comprising:

providing a washing machine with a drive shaft operatively coupled to rotate the basket, the drive shaft having normally associated and rotatable therewith a plurality of components necessary for proper mechanical rotational operation of the basket; and mounting a one part sensor to detect passage of at least one of said normally associated components whereby to provide a signal correlated to the speed of rotation of the basket without requiring addition of a second part for rotation with the drive shaft and whose purpose is primarily to function as part of a speed sensor;

wherein said normally associated components include a counterweight and a transmission, the method further comprising mounting the sensor to detect respective passage of the counterweight and an aspect of the transmission.

9. A method of sensing speed of rotation of a basket in a washing machine with a one part speed sensor comprising:

providing a washing machine with a drive shaft operatively coupled to rotate the basket, the drive shaft having normally associated and rotatable therewith a plurality of components necessary for proper mechanical rotational operation of the basket; and mounting a one part sensor to detect passage of at least one of said normally associated components whereby to provide a signal correlated to the speed of rotation of the basket without requiring addition of a second part for rotation with the drive shaft and whose purpose is primarily to function as part of a speed sensor;

wherein said normally associated components include a brake plate having at least one off-center aperture therein, the method further comprising mounting the sensor to detect passage of the off-center aperture; and wherein the washing machine includes a mounting plate adapted to be affixed to the washing machine to support the drive shaft, the mounting plate overlying the brake plate, the method further comprising mounting the sensor to the mounting plate.

10. The method of claim 9 further comprising mounting the sensor to the mounting plate in position to overlie a path of travel along which the aperture moves as the brake plate rotates.

11. The method of claim 9 further comprising forming a sensor aperture in the mounting plate so as to overlie a path of travel along which the brake plate aperture moves as the brake plate rotates, and mounting the sensor to the mounting plate at the aperture.

12. The method of claim 11 further comprising mounting the sensor to the mounting plate so as to project into the sensor aperture.

13. A method of sensing speed of rotation of a basket in a washing machine with a one part speed sensor comprising:

providing a washing machine with a drive shaft operatively coupled to rotate the basket, the drive shaft having normally associated and rotatable therewith a plurality of components necessary for proper mechanical rotational operation of the basket; and mounting a one part sensor to detect passage of at least one of said normally associated components whereby to provide a signal correlated to the speed of rotation of the basket without requiring addition of a second part for rotation with the drive shaft and whose purpose is primarily to function as part of a speed sensor;

wherein the normally associated components includes a ferrous metal component, the method further comprising providing a variable reluctance sensor as the one part sensor and wherein mounting the sensor includes mounting the sensor in a position to generate a signal in response to passage of the metal component.

14. A method of sensing speed of rotation of a basket in a washing machine with a one part speed sensor comprising:

providing a washing machine with a drive shaft operatively coupled to rotate the basket, the drive shaft having normally associated and rotatable therewith a plurality of components necessary for proper mechanical rotational operation of the basket; and mounting a one part sensor to detect passage of at least one of said normally associated components whereby to provide a signal correlated to the speed of rotation of the basket without requiring addition of a second part for rotation with the drive shaft and whose purpose is primarily to function as part of a speed sensor;

wherein there are at least two normally associated components, the two components being spaced apart along a common path of travel, the method including mounting the sensor to detect respective passage of the two such components.

15. The method of claim 14 wherein the two such components are defined by at least two off-center apertures in a plate mounted for rotation with the drive shaft.

16. A method of sensing speed of rotation of a basket in a washing machine comprising:

rotating a drive shaft with the basket operatively coupled for rotation therewith;

detecting the speed of rotation of the basket by detecting passage of a component normally associated and rotatable with the drive shaft for proper mechanical rotational operation of the basket without adding a component for rotation with the drive shaft the purpose of which is primarily to facilitate detection of the speed of rotation;

wherein the normally associated component includes a ferrous metal component, detecting the speed of rotation of the basket includes generating a signal from a variable reluctance positioned to be responsive to passage of the metal component.

* * * * *

UNITED STATES PATENT AND TRADEMARK OFFICE

CERTIFICATE OF CORRECTION

PATENT NO. : 6,568,018 B1
DATED : May 27, 2003
INVENTOR(S) : Chamberlin et al.

It is certified that error appears in the above-identified patent and that said Letters Patent is hereby corrected as shown below:

Title page,
Item [73], Assignee, please delete "Standet" and replace with -- Standex --;

Column 5,
Line 5, please delete "thus Improving" and replace with -- thus improving --;
Line 28, please delete "and bobbin 110 is" and replace with -- and bobbin 100 is --;

Column 10,
Line 34, please delete "variable reluctance positioned" and replace with -- variable reluctance sensor positioned --.

Signed and Sealed this

Twelfth Day of August, 2003

JAMES E. ROGAN
*Director of the United States Patent and Trademark Office*